US008123475B2

(12) United States Patent
Yang et al.

(10) Patent No.: US 8,123,475 B2
(45) Date of Patent: Feb. 28, 2012

(54) HEAT DISSIPATION FAN

(75) Inventors: Zhi-Ya Yang, Shenzhen (CN); Wen-Gao Wang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 460 days.

(21) Appl. No.: 12/430,850

(22) Filed: Apr. 27, 2009

(65) Prior Publication Data

US 2010/0172758 A1 Jul. 8, 2010

(30) Foreign Application Priority Data

Jan. 5, 2009 (CN) ..... 2009 1 0300055

(51) Int. Cl.

| | |
|---|---|
| ***F03B 1/00*** | (2006.01) |
| ***F03B 3/04*** | (2006.01) |
| ***F03D 1/04*** | (2006.01) |
| ***F04D 3/00*** | (2006.01) |
| ***F04D 19/00*** | (2006.01) |
| ***F04D 29/52*** | (2006.01) |

(52) U.S. Cl. ..... 415/220; 415/221

(58) Field of Classification Search ..... 415/216.1, 415/220, 229, 221; 417/424.2
See application file for complete search history.

(56) References Cited

U.S. PATENT DOCUMENTS

| | | | | |
|---|---|---|---|---|
| 7,140,837 | B2 * | 11/2006 | Ku et al. | 415/121.2 |
| 7,563,070 | B2 * | 7/2009 | Lin et al. | 415/118 |
| 7,607,887 | B2 * | 10/2009 | Yang et al. | 415/213.1 |
| 7,674,094 | B2 * | 3/2010 | Yeh et al. | 416/174 |
| 2005/0232754 | A1 * | 10/2005 | Ku et al. | 415/121.2 |
| 2010/0111698 | A1 * | 5/2010 | Wiedeman et al. | 416/189 |

* cited by examiner

*Primary Examiner* — S. V. Clark
(74) *Attorney, Agent, or Firm* — Altis Law Group, Inc.

(57) ABSTRACT

A heat dissipation fan includes a fan frame, a bearing assembly, a stator and a rotor. The fan frame includes a base and a central tube. The central tube includes an open top end and an open bottom end. The base defines a receiving concave at a bottom surface thereof. The receiving concave communicates with the central hole. A top wall is formed by the base over the concave. A sidewall is formed between the top wall and the bottom surface of the base and surrounds the concave. A plurality of first locking units extend from the top wall into the receiving concave. The bearing assembly includes an oil sealing cover for sealing the open bottom end of the central tube. The oil sealing cover includes a plurality of second locking units which are detachably interlocked with the first locking units to mount the oil sealing cover to the base.

10 Claims, 6 Drawing Sheets

HEAT DISSIPATION FAN

BACKGROUND

1. Technical Field

The present invention relates to a heat dissipation fan, and more particularly relates to a heat dissipation fan having an improved bearing assembly.

2. Description of Related Art

With the continuing development of the electronic technology, electronic packages such as CPUs (central processing units) are generating more and more heat that requires immediate dissipation. Heat dissipation fans are commonly used in combination with heat sinks for cooling CPUs.

A conventional heat dissipation fan includes a fan frame having a central tube extending upwardly from a base thereof, a bearing received in the central tube, a stator mounted around the central tube and a rotor rotatable with respect to the stator. The rotor includes a hub and a shaft extending from the hub into the bearing. The central tube has an opening defined at a top end thereof. The bearing is inserted into the central tube through the opening. An annular recess is defined in a top portion of the central tube and above a top end of the bearing.

When assembled, lubricating oil is injected into the central tube to lubricate the bearing and the shaft, and an oil retaining ring around the shaft is pressingly fitted in the annular recess of the central tube. Then, the top portion of the central tube is bent inwardly via a hot-melting tool to form a pressing portion abutting on a top surface of the oil retaining ring, and therefore an interior oil space of the central tube is almost hermetically sealed by the retaining ring for preventing the lubricating oil from leaking out of the central tube. However, when there is a requirement to replace the bearing received in the central tube, the original fan frame must be totally discarded as the hot-melting connection between the retaining ring and the central tube of the fan frame, which results in increasing cost of the heat dissipation fan. Additionally, the assembly of the retaining ring is completed via the hot-melting tool, which increases a complexity of the assembly process of the heat dissipation fan.

It is thus desirable to provide a heat dissipation fan which can overcome the described limitations.

DETAILED DESCRIPTION

Figure 1:
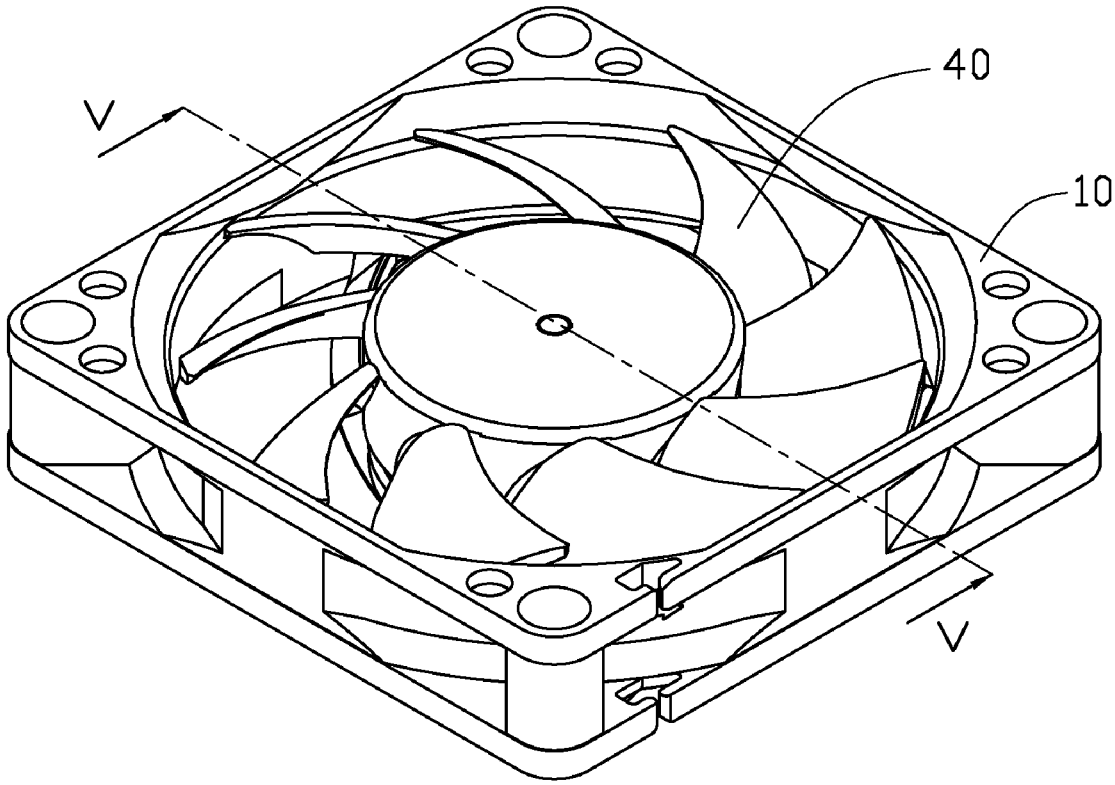
FIG. 1 is an isometric, assembled view of a heat dissipation fan according to an exemplary embodiment.

Reference will now be made to the drawing figures to describe the present heat dissipation device in detail.

Figure 2:
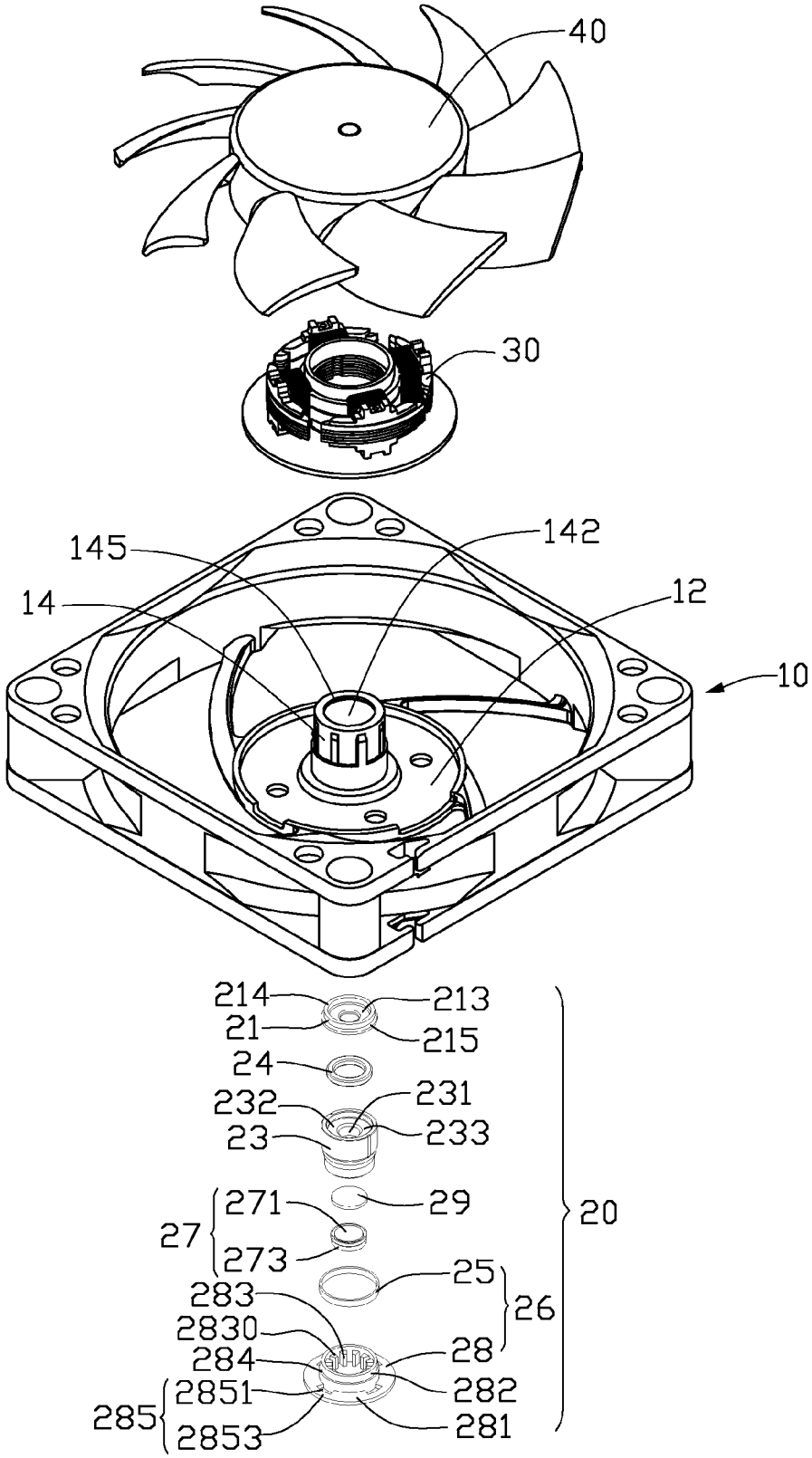
FIG. 2 is an exploded, isometric view of the heat dissipation fan of FIG. 1.
Figure 3:
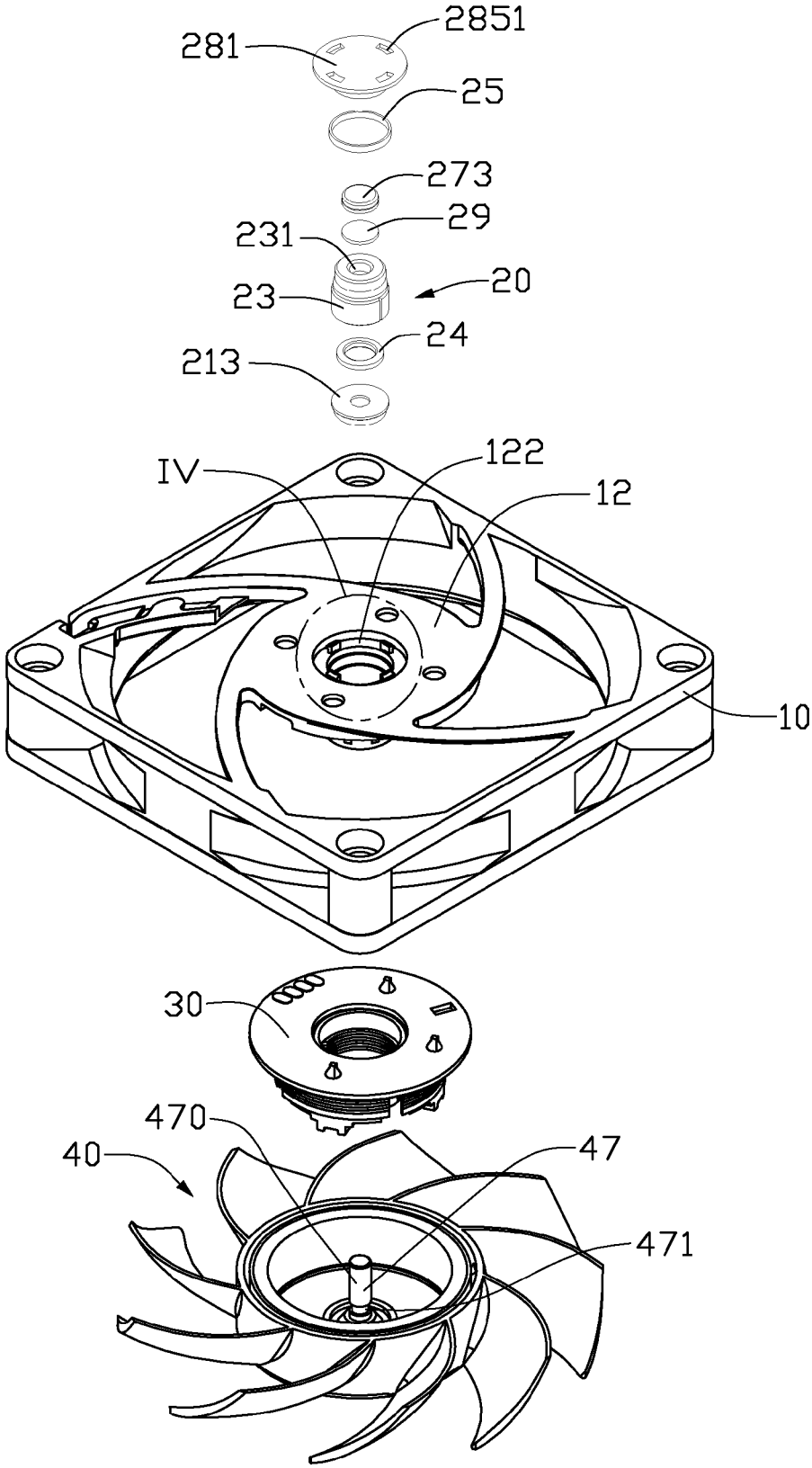
FIG. 3 is a view similar to FIG. 2, but shown in an up-side-down aspect.

Referring to FIGS. 1-3, a heat dissipation fan includes a rotor 40, a stator 30 in respect to which the rotor 40 is rotatable, a fan frame 10 receiving the rotor 40 and the stator 30 therein, and a bearing assembly 20.

Figure 4:
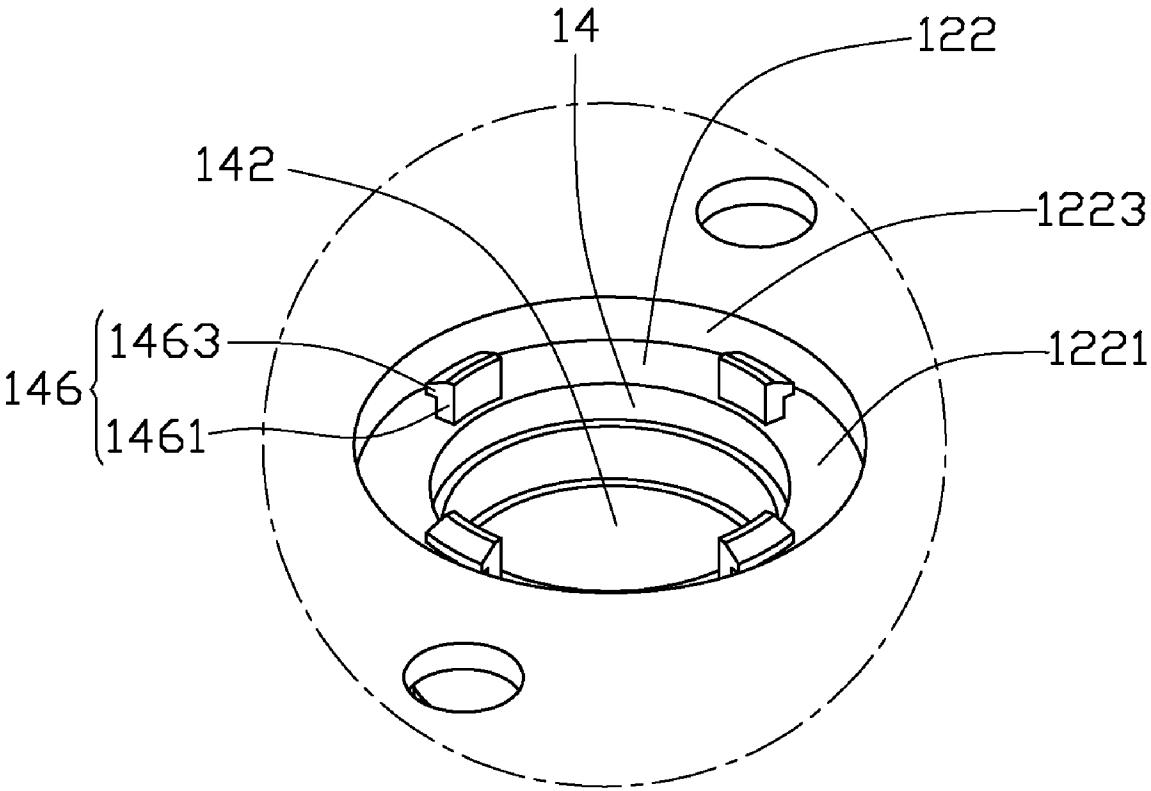
FIG. 4 is an enlarged view of a circled portion IV of FIG. 3.

The fan frame 10 includes a base 12 and a central tube 14 extending upwardly from a central portion of the base 12. The central tube 14 has a central hole 142 extending therethrough along an axis thereof, and thus forms an open top end and an open bottom end at two opposite ends, respectively. A pressing portion 145 protrudes radially and inwardly from the open top end of the central tube 14. Thus, the central tube 14 has an inner diameter at the pressing portion 145 smaller than the inner diameter at the other portion of the central tube 14. A receiving concave 122 is concaved from a bottom surface of the central portion of the base 12. The receiving concave 122 is coaxial with the central hole 142 of the central tube 14 and communicates with the central hole 142. A diameter of the receiving concave 122 is larger than the inner diameter of the central tube 14. Referring to FIG. 4, a top wall 1221 is formed by the base 12 at the bottom end of the central tube 14, and is located between the receiving concave 122 and the central hole 142. The top wall 1221 is annular and horizontal. A sidewall 1223 is formed by the base 12 around the receiving concave 122, interconnecting an outer periphery of the top wall 1221 and an inner periphery of the bottom surface of the base 12.

A plurality of first locking units 146 extend downwardly from an inner periphery of the top wall 1221, and are evenly disposed along a circumferential direction of the top wall 1221. There are four first locking units 146 provided in this preferred embodiment. Each of the first locking units 146 includes a fixing pole 1461 extending downwardly from the top wall 1221 and a hook 1463 extending outwardly from a bottom end of the pole 1461 towards the sidewall 1223. Each of the hooks 1463 faces the sidewall 1223, and spaces a distance from the sidewall 1223.

The bearing assembly 20 includes a locking washer 21, a bearing 23, a porous wick element 24, a wear pad 29, a magnetic unit 27, and an oil sealing cover 26. The bearing 23 is a sleeve bearing and made from sintering powers such as copper powders or ceramic powders. A plurality of pores (not shown) are defined in the bearing 23 and communicate with each other. The bearing 23 is received in the central hole 142 of the central tube 14. The bearing 23 defines an axial hole 231 therein for extension of a shaft 47 of the rotor 40 therethrough. The shaft 47 defines an annular slot 471 in a circumferential surface 470 thereof, at a position near a top end of the shaft 47. A circular cavity 232 is formed in a top portion of the bearing 23 with a diameter larger than that of the axial hole 231. The cavity 232 communicates with the axial hole 231. Thus, the top portion of the bearing 23 has an inner diameter which is larger than that of the other portion of the bearing 23, and therefore an annular step surface 233 is formed at the top portion of the bearing 23.

The porous wick element 24 is cylindrically-shaped in configuration. The porous wick element 24 is made of a porous material, such as polyurethane foam plastic, foamed metal or sponge. The porous wick element 24 is received in the cavity 232 of the bearing 23. More specifically, a bottom surface and an outer circumferential surface of the porous wick element 24 are interferentially and intimately attached to the step surface 233 of the bearing 23 and an inner circumferential surface of the top end of the bearing 23 surrounding the cavity 232, respectively. A plurality of pores (not shown) are defined in the porous wick element 24 and communicate with each other.

The locking washer 21 includes an annular retaining ring 213 and a flange 214 extending upwardly and perpendicularly from a top surface of the retaining ring 213. The retaining ring 213 defines an inner hole in a middle portion for extension of the shaft 47 therethrough. A diameter of the inner hole of the retaining ring 213 is slightly larger than a diameter of the circumferential surface 470 of the shaft 47 at the slot 471, but smaller than a diameter of the other portions of the shaft 471.

Thus, the retaining ring 213 of the locking washer 23 is engaged in the slot 471 of the shaft 47 to limit an axial movement of the shaft 47. A narrow gap is defined between an inner circumferential surface of the retaining ring 213 and the circumferential surface 470 of the shaft 47 defining the slot 471, in order to avoid an interference between the shaft 47 and the retaining ring 213 during rotation of the shaft 47. The flange 214 offsets inwardly a distance with respect to an outer periphery of the retaining ring 213. That is, an outer diameter of the retaining ring 213 is larger than an outer diameter of the flange 214, thereby forming a step 215 on the top surface of the retaining ring 213 adjacent to the outer periphery of the retaining ring 213. A width of the step 215 substantially equals to a width of the pressing portion 145 of the central tube 14. The retaining ring 21 substantially seals the open top end of the central tube 14 with the pressing portion 145 abutting on the step 215 of the retaining ring 213, for blocking the locking washer 21, the bearing 23, the wear pad 29, the magnetic unit 27 and the oil sealing cover 26 from slipping out of the central tube 14 via the open top end.

The magnetic unit 27 includes a magnetic yoke 273 and a columned magnet 271. The magnetic yoke 273 is cup-shaped, and an axial cross-sectional view of the magnetic yoke 273 is "U" shaped. The magnetic yoke 273 encloses the magnet 271 therein, with a top surface of the magnet 271 exposed out of the magnetic yoke 273.

The wear pad 29 is made of high abrasion resistant material. The wear pad 29 is mounted at a bottom end of the bearing 23 for supporting the bottom end of the shaft 47.

The oil sealing cover 26 includes an oil lid 28 and a sealing ring 25. Referring back to FIG. 2, the oil lid 28 includes a circular bottom wall 281, an annular wall 282 extending upwardly and perpendicularly from the bottom wall 281, a plurality of protruding members 283 formed on an inner circumferential surface of the annular wall 282 and a plurality of second locking units 285. A diameter of the bottom wall 281 of the oil lid 28 substantially equals to the diameter of the receiving concave 122. Thus, the oil lid 28 can be fitly received in the receiving concave 122. The second locking units 285 are configured for detachably interlocking with the first locking units 146, respectively, to mount the oil lid 28 in the receiving concave 122 of the base 12 to thereby seal the open bottom end of the central tube 14. The second locking units 285 are defined in the bottom wall 281 and evenly disposed along a circumferential direction of the bottom wall 281. Each of the second locking units 285 includes a through hole 2851 immediately adjacent to an outer periphery of the annular wall 282 and a fastening strip 2853 formed by the bottom wall 281 and located at a position radially outwards of the through hole 2851. The through hole 2851 is for receiving a corresponding pole 1461 of the first locking unit 146 therein, and the fastening strip 2853 is for clasping a corresponding hook 1463 of the first locking unit 146 thereof.

The protruding members 283 are evenly disposed along the circumferential direction of the annular wall 282. Each of the protruding members 283 extends along an axial direction of the annular wall 282, and forms an inclined guiding surface 2830 on a top side thereof. A top portion of the annular wall 282 has an outer diameter which is smaller than that of a bottom portion of the annular wall 282, thereby forming a supporting surface 284 at a junction of the top portion and the bottom portion of the annular wall 282. The outer diameter of the top portion of the annular wall 282 substantially equals to the diameter of the central hole 142 of the central tube 14. The sealing ring 25 has an inner diameter substantially equals to the outer diameter of the top portion of the annular wall 282, and has an outer diameter slightly larger than the outer diameter of the bottom portion of the annular wall 282.

Figure 5:
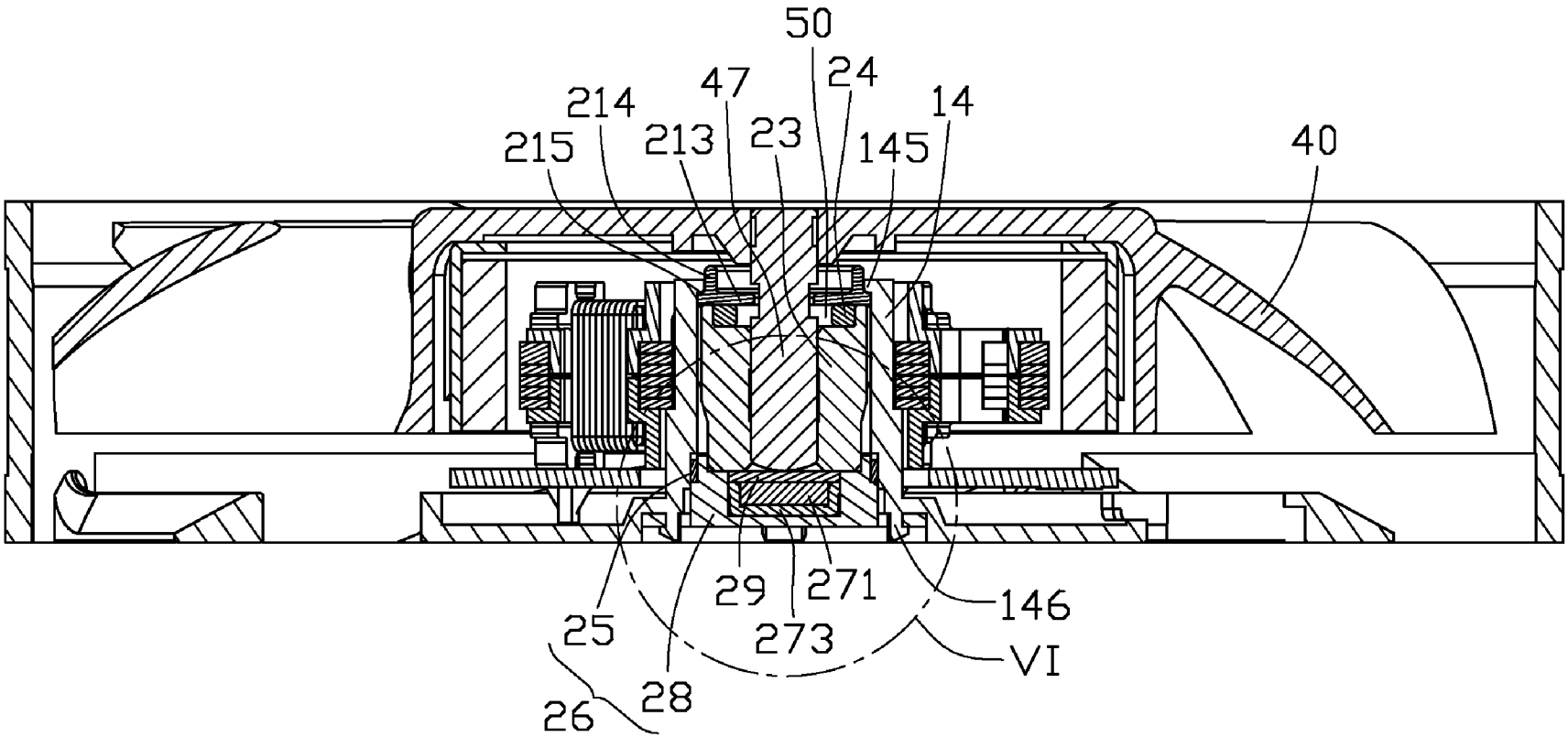
FIG. 5 is a cross-section of the heat dissipation fan of FIG. 1, taken along line V-V thereof.

Referring to FIG. 5, when assembled, the locking washer 21 is firstly mounted into the central tube 14 via the open bottom end of the central tube 14 through the receiving concave 122 at the base 12 of the fan frame 10, and then the bearing 23 with the porous wick element 24 received in the cavity 232 thereof is mounted into the central tube 14 via the open bottom end. The pressing portion 145 of the central tube 14 abuts on the step 215 of the retaining ring 213 of the locking washer 21 for holding the locking washer 21 and the bearing 23 in the central tube 14. The shaft 47 extending through the inner hole of the retaining ring 213 is rotatably received in the bearing 23. The retaining ring 213 of the locking washer 21, the bearing 23 and the shaft 47 cooperatively form an oil reservoir 50 thereamong, which is positioned at the top portion of the bearing 23. The porous wick element 24 is received in the oil reservoir 50.

Figure 6:
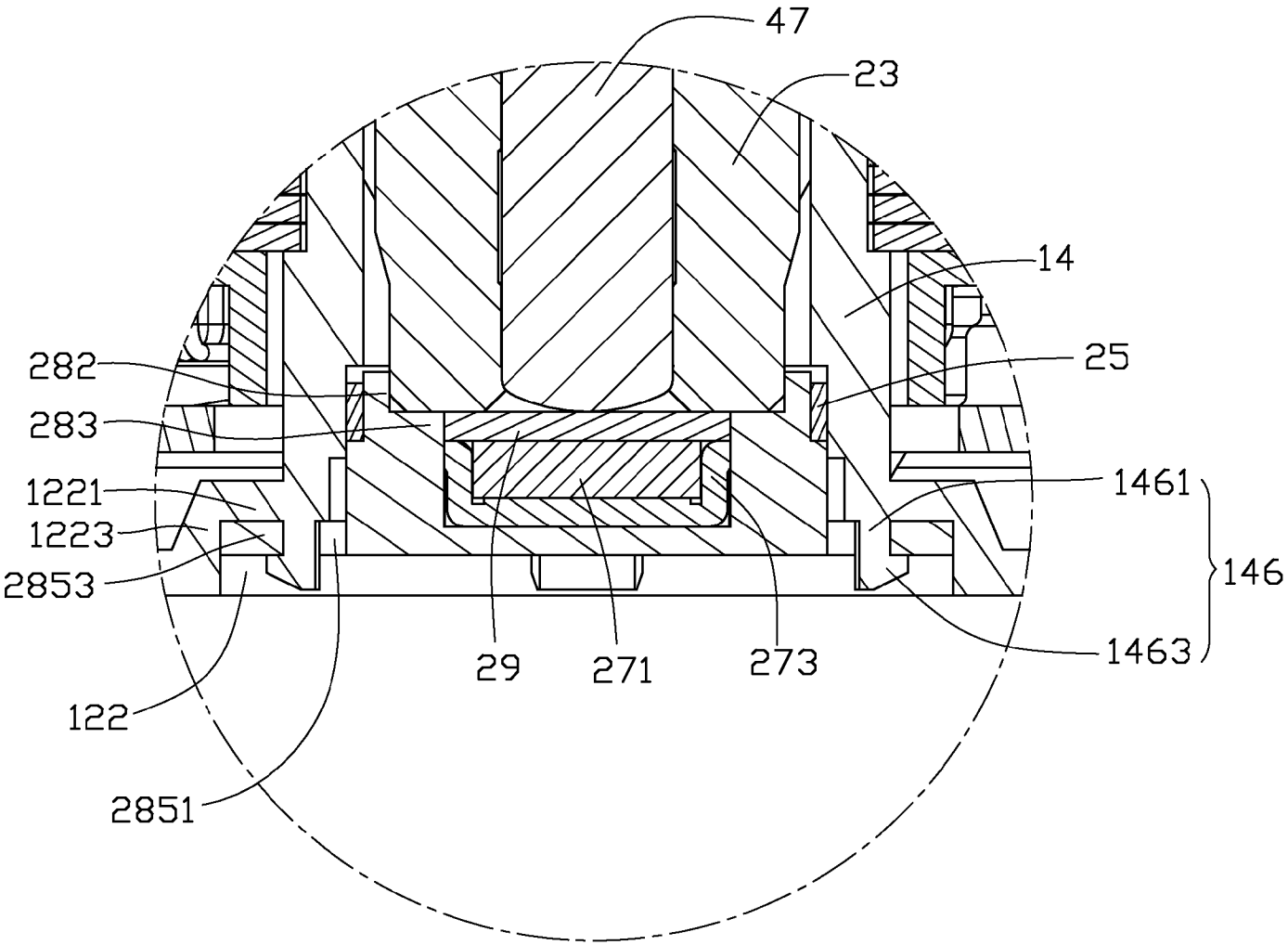
FIG. 6 is an enlarged view of a circled portion VI of FIG. 5.

The oil sealing cover 26 is detachably connected to the base 12 of the fan frame 10 via the second locking units 285 of the oil lid 28 interlocked with the first locking units 146 located in the receiving concave 122 of the central tube 14, for sealing the open bottom end of the central tube 14. Referring to FIG. 6, the bottom wall 281 of the oil lid 28 is pressingly fitted in the receiving concave 122. The poles 1461 of the first locking units 146 extending downwardly form the top wall 1221 traverse through the through holes 2851 of the bottom wall 281, respectively, and the hooks 1463 clasp bottom sides of the fastening strips 2853. The top surface of the bottom wall 281 tightly contacts with a bottom surface of the top wall 1221. The annular wall 282 extends upwardly into the central hole 142 of the central tube 14 and abutting the bottom end of the bearing 23. The wear pad 29 and the magnetic unit 27 are received in the annular wall 282 of the oil lid 28, wherein the protruding members 283 provide a close contact between an outer circumferential surface of the magnetic unit 27 and the inner circumferential surface of the annular wall 282. The wear pad 29 covers the top surface of the magnet 271 and contacts the bottom end of the shaft 47. The sealing ring 25 is mounted around the top portion of the annular wall 282 and seated on the supporting surface 284. The sealing ring 25 is pressingly fitted between an inner circumferential surface of the bottom portion of the central tube 14 and an outer surface of the top portion of the annular wall 282. Accordingly, the oil sealing cover 26 completely covers the open bottom end of the central tube 14. The oil sealing cover 26 and the central tube 14 cooperatively form a receiving room having a sealed bottom end for receiving the washer locker 21, the bearing 23, the shaft 47, the wear pad 29 and the magnetic unit 27 therein.

During operation, the rotor 40 is driven to rotate by the interaction between the alternating magnetic field established by the stator 30 and the rotor 40. The magnet 271 of the magnetic unit 27 can generate a magnetic attraction force which attracts the shaft 47 to always maintain in contact with the wear pad 29 and prevents the shaft 47 from floating along an axial direction of the bearing 23. The axially upward movement of possible floating of the rotor 40 during operation of the heat dissipation fan is avoided, whereby the rotor 40 is maintained to rotate steadily. The lubricating oil creeps up along the rotating shaft 47 under the influence of the centrifugal force generated by the rotation of the shaft 47 and then escapes to the oil reservoir 50 through a clearance defined between a top end of the bearing 23 and the shaft 47. The slot 471 of the shaft 47 prevents the oil from continuously creeping up along the shaft 47. Since the oil reservoir 50 is almost hermetically sealed by the retaining ring 213, the retaining ring 213 can prevent the lubricating oil from leaking out of the oil reservoir 50. The plurality of pores of the porous wick element 24 can absorb the lubricating oil accumulated in the oil reservoir 50, thereby further preventing the lubricating oil from leaking out of the oil reservoir 50. The lubricating oil is then returned back to the bearing 23 from the oil reservoir 50 under a capillary force generated by the pores of the bearing 23, thus to accelerate the lubricating oil flowing back to the sealed bottom end for circulation.

As the oil sealing cover 26 and the central tube 14 cooperatively forming the receiving room which has the sealed bottom end, the lubricating oil flowing back to the bearing 23 is prevented from leakage out of the central tube 14 through the open bottom end thereof. The lubricating oil is blocked from leaking out of the central tube 14, and good lubrication of the bearing 23 and the shaft 47 is thus consistently maintained, thereby improving the quality and life-span of the heat dissipation fan. On the other hand, as the oil sealing cover 26 is detachably connected to the open bottom end of the central tube 14 via the second locking units 285 of the oil lid 28 interlocked with the first locking units 146, the bearing assembly 20 can be mounted into/taken out of the central tube 14 via the open bottom end of the central tube 14. The pressing portion 145 of the central tube 14 is formed by an injection molding of the fan frame 10, and no hot-melting tool is needed. Moreover, when one part of the bearing assembly 20 is needed to be replaced or repaired, the second locking units 285 of the oil sealing cover 26 can be disengaged form the first locking units 146 of the open bottom end of the central tube 14 easily. Then, the oil sealing cover 26 is dismounted form the open bottom end of the central tube 14. The oil sealing cover 26 is separated from the base 12 of the fan frame 10, and the damaged part of the bearing assembly 20 can be replaced.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation fan comprising:

a fan frame comprising a base and a central tube extending upwardly from the base, the central tube defining a central hole therein and comprising an open top end and an open bottom end, the base defining a receiving concave at a bottom surface thereof, the receiving concave being coaxial with the central hole of central tube and communicated with the central hole, a top wall being formed on the base at a top side of the concave, a sidewall being formed between the top wall and the bottom surface of the base and surrounding the concave, a plurality of first locking units extending downwardly from the top wall of the central tube into the receiving concave;

a bearing assembly comprising a bearing received in the central hole of the central tube and an oil sealing cover for sealing the open bottom end of the central tube, the bearing defining a bearing hole therein, the oil sealing cover comprising a plurality of second locking units, the second locking units being detachably interlocked with the first locking units to mount the oil sealing cover to the receiving concave of the base;

a stator mounted around the central tube; and a rotor comprising a shaft extending through the open top end of the central tube to be received in the bearing hole of the bearing;

wherein the oil sealing cover comprises an oil lid, the oil lid comprising a bottom wall pressingly fitted in the receiving concave and an annular wall extending upwardly from the bottom wall into the central hole of the central tube; and wherein each of the first locking units comprises a pole extending downwardly from an inner periphery of the top wall and a hook formed at a bottom end of the pole, each of the second locking units comprising a through hole defined in the bottom wall for a corresponding pole extending therethrough and a fastening strip located out of the through hole for clasping a corresponding hook.

2. The heat dissipation fan of claim 1, wherein an outer diameter of the annular wall substantially equals to a diameter of a bottom portion of the central hole, and the second locking units are evenly disposed around the annular wall.

3. The heat dissipation fan of claim 1, further comprising a sealing ring, the sealing ring mounted around the annular wall and pressingly fitted between an inner circumferential surface of the central tube and an outer surface of the annular wall.

4. The heat dissipation fan of claim 1, wherein the oil lid comprises a plurality of protruding members formed on an inner circumferential surface of the annular wall, each of the protruding members forming an inclined guiding surface on a top side thereof.

5. The heat dissipation fan of claim 1, further comprising a magnetic unit and a wear pad received in the annular wall of the oil lid, the magnetic unit comprising a magnet and a cup-shaped magnetic yoke enclosing the magnet therein, a top surface of the magnet being exposed out of the magnetic yoke and facing a bottom end of the shaft, the wear pad covered on the top surface of the magnet and contacted the bottom end of the shaft.

6. The heat dissipation fan of claim 1, further comprising a locking washer fixed on the open top end of the central tube, the locking washer comprising a retaining ring mounted around the shaft and a flange extending upwardly from the retaining ring, a step being formed by a portion of the stop surface of the retaining ring between the flange and an outer periphery of the retaining ring, a pressing portion protruding inwardly from the open top end of the central tube and pressing on the step for blocking the locking washer and the bearing in the central tube from moving out of the central tub via the open top end thereof.

7. The heat dissipation fan of claim 1, further comprising a porous wick element between the bearing and the locking washer, the porous wick element being made of a porous material and defining a plurality of pores therein.

8. A heat dissipation fan comprising:

a fan frame comprising a base and a central tube extending upwardly from a top surface of the base, the central tube defining a central hole therein comprising an open top end and an open bottom end, a plurality of hooks extending downwardly from the base around the open bottom end of the central tube;

a bearing assembly comprising a bearing received in the central hole of the central tube and an oil sealing cover for sealing the open bottom end of the central tube, the oil sealing cover comprising a bottom wall attaching to the base and sealing the open bottom end of the central tube and an annular wall extending from a central portion of the bottom wall into the central tube, the hooks of the fan frame engaging with a portion of the bottom wall around the annular wall to mount the oil sealing cover to the open bottom end of the central tube;

a stator mounted around the central tube; and a rotor comprising a shaft extending through the open top end of the central tube to be fittingly received in the bearing;

wherein the base defines a receiving concave at a bottom surface thereof, the receiving concave being coaxial with the central hole of central tube and communicated with the open bottom end of the central tube, a diameter of the receiving concave being larger than a diameter of the central hole, a step being formed on the bottom open end of the central tube at a joint of the central hole and the concave, the hooks extending from the step, and the oil sealing cover being received in the concave.

9. The heat dissipation fan of claim 8, further comprising a sealing ring pressingly fitted between the annular wall of the oil sealing cover and the central tube.

10. A heat dissipation fan comprising:

a fan frame comprising a base and a central tube extending upwardly from the base, the central tube defining a central hole and comprising an open top end and an open bottom end, the base defining a receiving concave at a bottom surface thereof, the receiving concave being coaxial with the central hole of central tube and communicated with the central hole, a top wall being formed on the base at a top side of the concave, a sidewall being formed between the top wall and the bottom surface of the base and surrounding the concave, a plurality of first locking units extending downwardly from the top wall of the central tube into the receiving concave;

a bearing assembly comprising a bearing received in the central tube and an oil sealing cover for sealing the open bottom end of the central tube, the bearing defining a bearing hole therein, the oil sealing cover comprising a plurality of second locking units, the second locking units being detachably interlocked with the first locking units to mount the oil sealing cover to the receiving concave of the base;

a stator mounted around the central tube; and a rotor comprising a shaft extending through the open top end of the central tube to be received in the bearing hole of the bearing;

wherein the oil sealing cover comprises an oil lid, the oil lid comprising a bottom wall pressingly fitted in the receiving concave and an annular wall extending upwardly from the bottom wall into the central hole of the central tube; and wherein the heat dissipation fan further comprises a sealing ring, the sealing ring mounted around the annular wall and pressingly fitted between an inner circumferential surface of the central tube and an outer surface of the annular wall.

* * * * *